US006036736A

United States Patent [19]

Wallace et al.

[11] Patent Number: 6,036,736

[45] Date of Patent: Mar. 14, 2000

[54] VENTILATING METHOD AND APPARATUS

[75] Inventors: James M. Wallace; Michael R. Rayburn, both of Reno, Nev.

[73] Assignee: Wells Manufacturing Company, Inc., Verdi, Nev.

[21] Appl. No.: 09/055,111

[22] Filed: Apr. 3, 1998

[51] Int. Cl.[7] ..... F24C 15/20

[52] U.S. Cl. ..... 55/385.2; 55/385.1; 55/484; 55/485; 55/DIG. 18; 55/DIG. 36

[58] Field of Search ..... 55/484, 485, 486, 55/385.1, 385.2, 385.4, DIG. 18, DIG. 36

[56] References Cited

U.S. PATENT DOCUMENTS

| | | | |
|---|---|---|---|
| 3,530,784 | 9/1970 | Courchesne | 55/DIG. 36 |
| 3,954,427 | 5/1976 | Jenn | 55/DIG. 36 |
| 4,854,949 | 8/1989 | Giles, Sr. et al. | 55/DIG. 36 |
| 4,902,316 | 2/1990 | Giles, Sr. et al. | 55/DIG. 36 |
| 5,002,040 | 3/1991 | MacFarlane | 55/DIG. 36 |
| 5,154,161 | 10/1992 | Rogers et al. | 55/DIG. 36 |
| 5,662,097 | 9/1997 | Panos | 55/DIG. 36 |
| 5,690,018 | 11/1997 | Hansen | 55/DIG. 36 |
| 5,704,955 | 1/1998 | Giles | 55/DIG. 36 |
| 5,718,219 | 2/1998 | Boudreault | 55/DIG. 36 |

*Primary Examiner*—David A. Simmons
*Assistant Examiner*—Minh-Chau T. Pham
*Attorney, Agent, or Firm*—Herbert C. Schulze

[57] ABSTRACT

A ventilator hood including an air blower suitable to draw fumes emanating from a fume producing apparatus through a contaminate filter, a charcoal filter, and a HEPA filter including filter condition indicating means, fire suppression means, and special adapter plate means for directly connecting the ventilator hood to the fume producing apparatus.

10 Claims, 6 Drawing Sheets

FIG.5
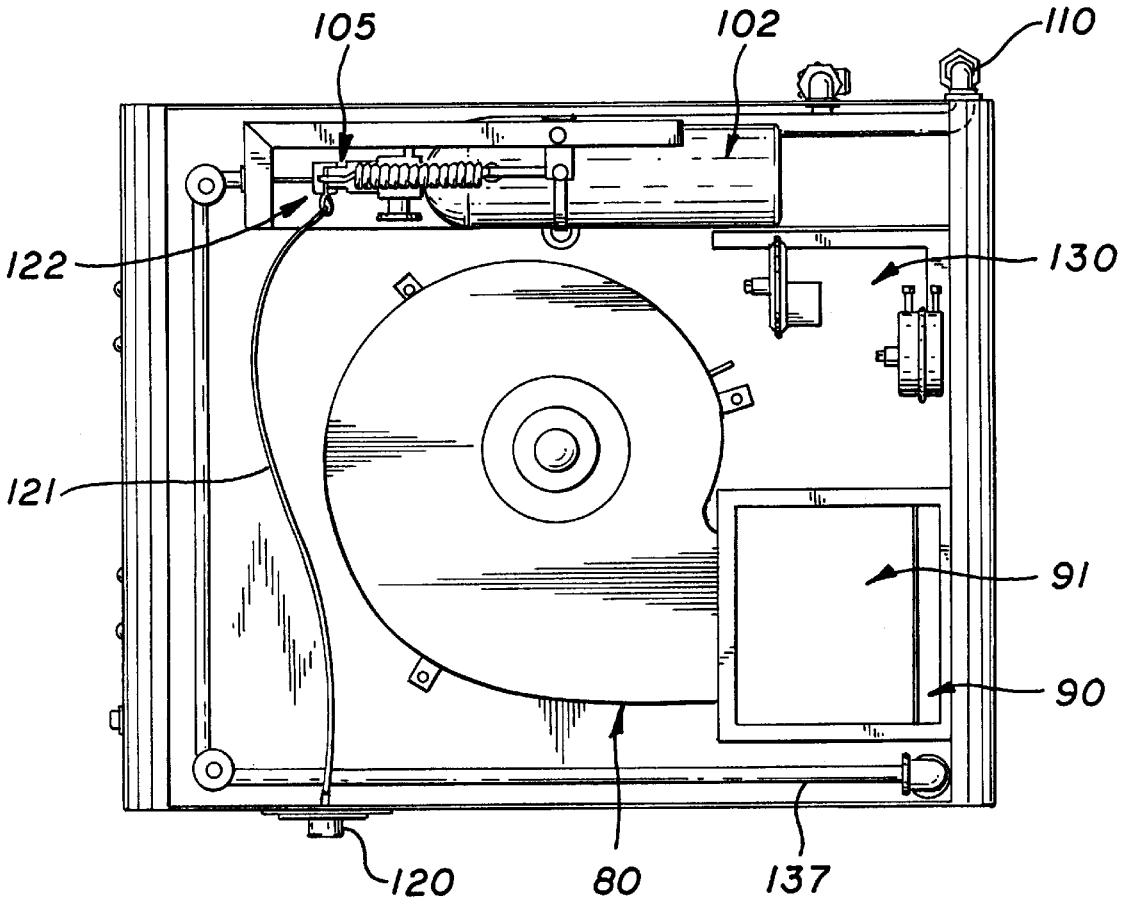
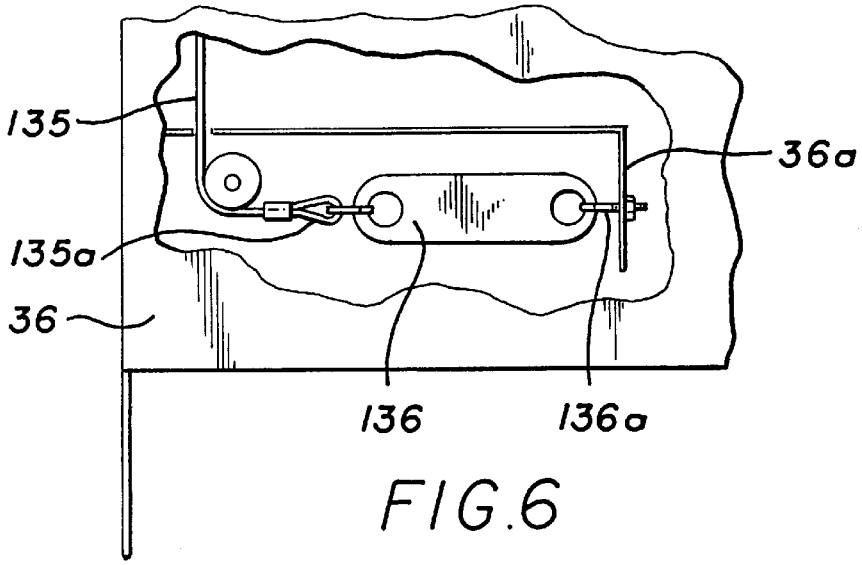
FIG.6

VENTILATING METHOD AND APPARATUS

CROSS REFERENCE TO RELATED PATENT APPLICATIONS

This application is related to our co-pending Design Patent application Ser. No. 29/078,795 filed Oct. 31, 1997.

BACKGROUND OF THE INVENTION

I. Field of the Invention

This invention is in the general field of ventilating systems;

The invention is more particularly in the field of ventilator hoods which may be used for independent ventilation of a space, or for fumes to be removed resulting from use of appliances such as ovens or fumes resulting from any activity;

The invention is even more particularly directed to such a ventilating system with fire suppression means.

II. Description of the Prior Art

There have been so many ventilating systems that it is not feasible to list them all. The present invention is unique in that it combines certain ventilating methods and apparatus into a unique combination including a special mounting plate allowing it to be mounted on certain types of equipment such as ovens and the like, and, also to mount upon any desired surface or framework and a fire suppression system operated by unique fail-safe mechanisms.

SUMMARY OF THE INVENTION

There are numerous uses for ventilating systems. Ventilating systems are needed in such places as restaurants, bakeries, kitchens of all natures, industrial situations such as plating, and numerous others too numerous to mention.

There have been many ventilating systems developed in the past. However a problem area has been an unsatisfied need for a safe, efficient, and universal ventilating system combining special mounting means to adapt directly to other equipment such as ovens or the like, safe and efficient fire suppression, and effective automatic and manual operating features.

We have now solved the problem. We have accomplished this by providing a unique ventilating system incorporating special impurity trapping elements, a fire suppression system with unique automatic and manual activating means, and a unique mounting plate for mounting in cooperation with fume generating equipment.

It is an object of this invention to provide a ventilating system incorporating a safe fire suppression system;

It is another object of this invention to provide such a ventilating system with a unique mounting arrangement to mount on various fume generating equipment;

Another object of this invention is to provide a ventilating system incorporating impurity collecting means;

Still another object of this invention is to provide a ventilating system incorporating means to indicate the condition of incorporated filters.

The foregoing and other objects and advantages will become apparent to those skilled in the art upon reading the description of a preferred embodiment in conjunction with a review of the appended drawings.

BRIEF DESCRIPTION OF THE DRAWINGS

FIG. 5 is a schematic top plan view with the cover removed showing the blower, fire suppression arrangement and certain switching;

FIG. 6 is an enlarged partial plan of the rear of the apparatus of figure one broken away to show the fire suppression linkage;

DESCRIPTION OF A PREFERRED EMBODIMENT

Figure 1:
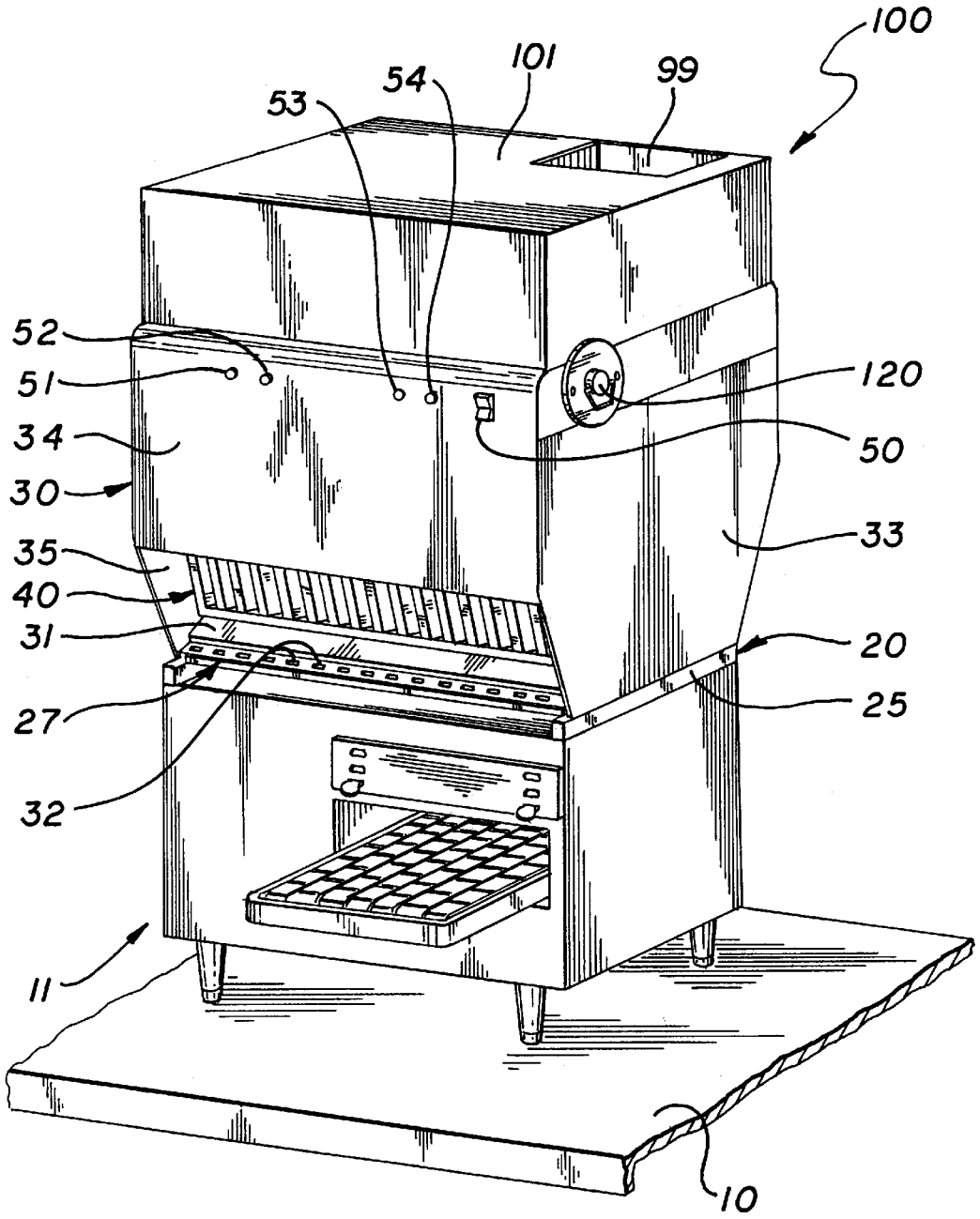
FIG. 1 is a perspective of the left front showing an apparatus suitable to practice the method of this invention in place over a fume generating oven.
Figure 2:
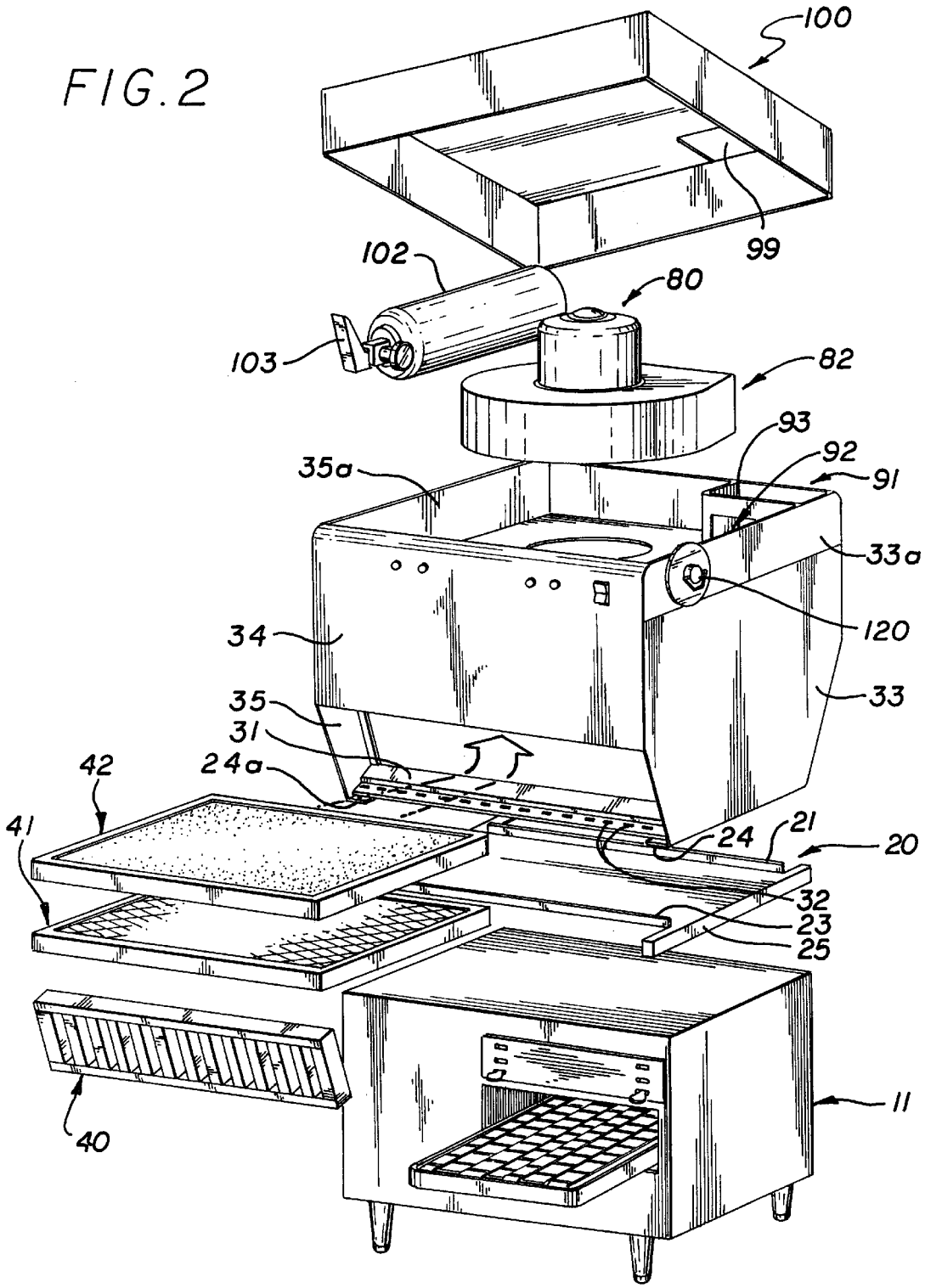
FIG. 2 is an exploded view of the apparatus of FIG. 1.

We will first list an inventory of all of the reference numerals used on the appended drawings:

Numeral Description

10 base surface
11 oven
11*a* oven electrical and control housing
20 adapter plate
21 adapter plate lip
22 front grease baffle catch trays
22*a* rear grease baffle catch trays
23 adapter plate lip
24 front ventilator hood adapter plate mounting flange
24*a* rear ventilator hood adapter plate mounting flange
25 adapter plate mounting element
30 ventilator hood
31 front grease baffle drain plate
31*a* rear grease baffle drain plate
32 openings in front grease baffle catch trays
32*a* openings in rear grease baffle catch trays
33 left side panel
33*a* upper left side panel
34 front panel
35 right side panel
35*a* upper right side panel
36 rear panel
36*a* fusible link mounting bracket
40 front grease baffle filter
40*a* front grease baffle filter switch
41 HEPA filter
41*a* HEPA filter switch
41*b* HEPA filter tension pin
42 charcoal filter
42*a* charcoal filter switch
42*b* charcoal filter tension pin
43 vent space beneath hood
45 front grease filter baffle switch activator
46 rear grease filter baffle switch activator
48 rear grease baffle filter

48*a* rear grease baffle filter switch
50 ventilator hood activation switch
51 ventilator power on indicator light
52 check filter indicator light
53 replace filters indicator light
54 service required indicator light
80 blower assembly
81 air flow path indicators
82 blower air outlet
85 electrical wiring conduit
86 power cord
90 insulating chamber
91 exhaust outlet
92 opening in exhaust outlet blower outlet
93 exhaust stack
99 exhaust stack outlet in cover
100 top cover chamber
102 fire extinguisher
103 fire extinguisher handle
105 fire extinguisher handle tension device
110 extinguisher fluid conduit
111 extinguisher fluid discharge orifice
120 manual fire extinguisher activator
121 manual fire extinguisher cable
122 fire extinguisher release pin
130 air vacuum switch assembly
135 fire extinguisher release cable
135*a* cable connection to fusible link
136 fusible link
136*a* fusible link connection to mounting bracket
137 fire extinguisher release cable conduit FIG. 1 shows a ventilator hood suitable to practice the method of this invention. In FIG. 1 the ventilator hood, generally 30, is shown mounted to an adapter plate 20 by means of front and rear adapter plate mounting flanges 24 and 24*a*. The adapter plate fits onto an oven 11, which is equipped with customary electrical and control mechanisms 11*a*. The oven rest on base surface, such as a floor, 10. This ventilator hood is shown in this configuration for illustration only. By use of our special adapter plate, the ventilator hood and method this invention could be mounted and used entirely independently of an appliance or on a variety of ovens and other types of fume producing equipment. Adapter plate 20 has a front lip 21 and rear lip 23 as indicated. The Adapter plate 20 has two mounting elements 25 and 27. This combination results in a perfect fit of the ventilator hood to oven 11 or other fume producing apparatus.

Sloping front and rear grease baffle drain plates 31 and 31*a* allow contaminants such as grease, chemicals, or the like to drain into front and rear grease catch trays 22 and 22*a* through openings 32 and 32*a*.

The exterior of the ventilator hood is formed by the adapter plate 20 on the bottom with a vent space 43, a cover chamber 100 on the top, left side panel 33, upper left side panel 33*a*, right side panel 35, upper right side panel 35*a*, front panel 34, and rear panel 36.

Front grease baffle filter 40 and rear grease baffle filter 48 are provided as shown. HEPA filter 41 and charcoal filter 42 are installed within the hood as shown.

The filters are all mounted in a unique manner between switches and tension pins as shown. The front and rear grease baffles are mounted between switches 40*a* and 48*a* and activators 45 and 46. The HEPA filter is mounted between switch 41*a* and tension pin 41*b*. The charcoal filter is mounted between switch 42*a* and tension pin 42*b*. With this mounting arrangement, if a filter is not in place, the hood may be disabled or it may display a warning such as the various filter attention lights 52, 53, and 54. Other controls include the ventilator hood activation switch 50, and power on indicator 51.

The blower assembly 80 and fire extinguisher 102 are located within the top cover chamber 100 as shown. The blower is a commonly known blower powered by an electrical motor in customary fashion known to those skilled in the art. The blower air outlet 82 feeds through exhaust outlet 91 and opening 92 into exhaust stack 93 and out exhaust stack outlet 99 in the cover. The exhaust stack has an insulating chamber 91 to keep the exterior of the cover relatively cool at the stack area.

Figure 3:
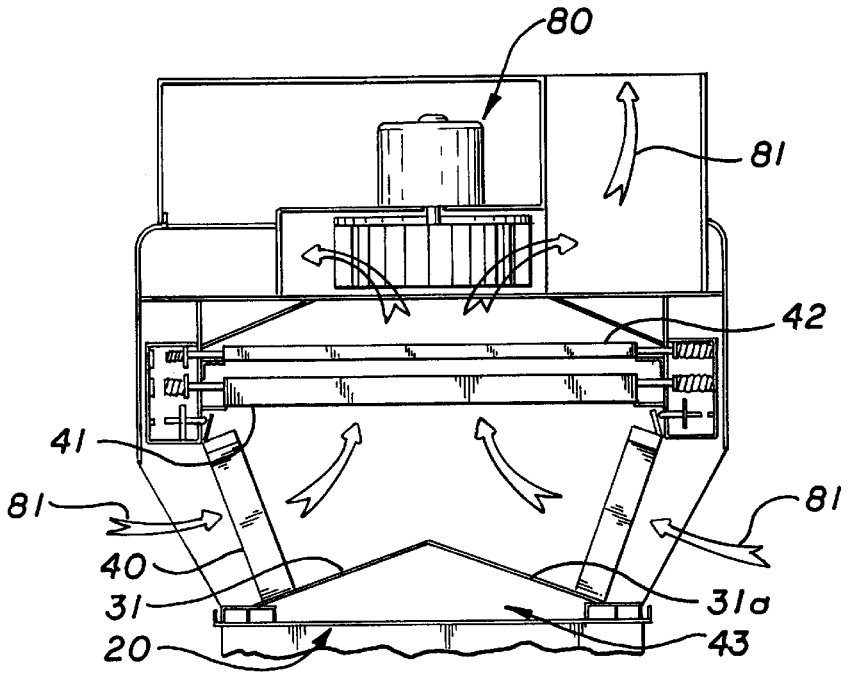
FIG. 3 is a schematic left side view with the left side cover removed showing the air flow through the apparatus of FIG. 1.
Figure 4:
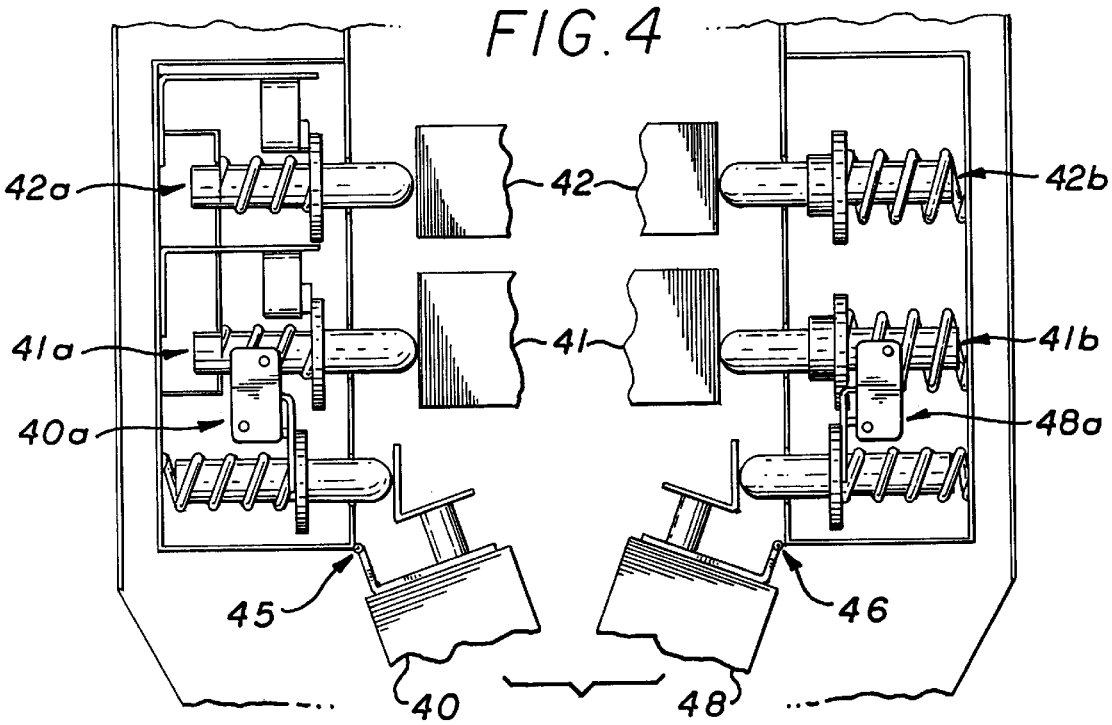
FIG. 4 is an enlarged, partially broken away, schematic view of the filter indicating switches of the apparatus of FIG. 1.

In FIG. 3 the air flow path is indicated by the arrows 81.

Electrical wiring conduit 85 and power cord 86 supply the necessary electrical power to the unit.

Figure 7:
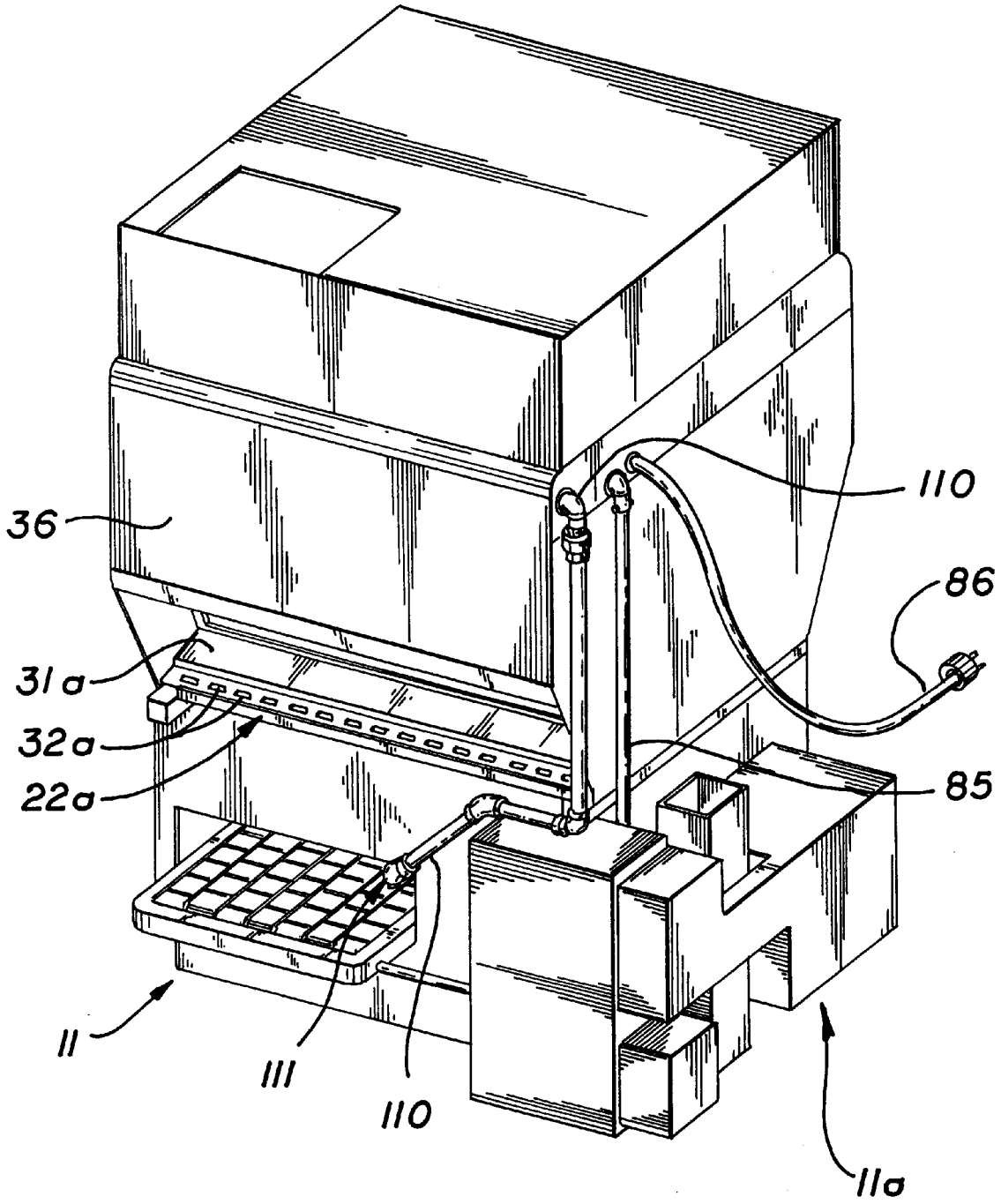
FIG. 7 is a perspective of the right rear of the apparatus of FIG. 1.

For fire suppression we prefer the Ansul Stored Pressure Wet Agent Fire Suppression System (Ansul Fire Protection, One Stanton Street, Marinette, Wis. 54143-2542). Other fire protection systems installed in a manner similar to that shown and described in this application might be used. We do not intend to be limited by this feature. The fire extinguisher 102 has handle 103 fastened to tension device 105 in a manner known to those skilled in the art. We have connected the fire extinguisher discharge nozzle to a conduit 110 which runs within the cover 100 and out the side as shown in FIGS. 5 and 7. This conduit terminates in a discharge orifice at 111 adjacent the rear of the oven. The fire extinguisher can be activated by failure of a fusible link 136 mounted at 136*a* between mounting bracket 36*a* and fire extinguisher release cable 135 (housed in cable conduit 137) through cable connection 135*a*. The extinguisher can also be activated by manually pulling on the manual activator 120 which removes the extinguisher release pin 122 by use of the cable 121.

In FIG. 5 the air vacuum switch assembly is shown. Through this assembly, the vacuum switches each have a high and a low side. When a balance exists between the high and low sides, the system is operating properly. In the event improper filtration exists, the vacuum switch may shut down the unit and a "service required" light may be activated. When the small vacuum switch senses a substantial drop in air flow, the "replace filter" light may be activated. At this point, the unit will continue to function. If the air flow is restricted beyond the normal filtration limits, the large vacuum switch can cause a full shut down of the ventilator hood.

Figure 8:
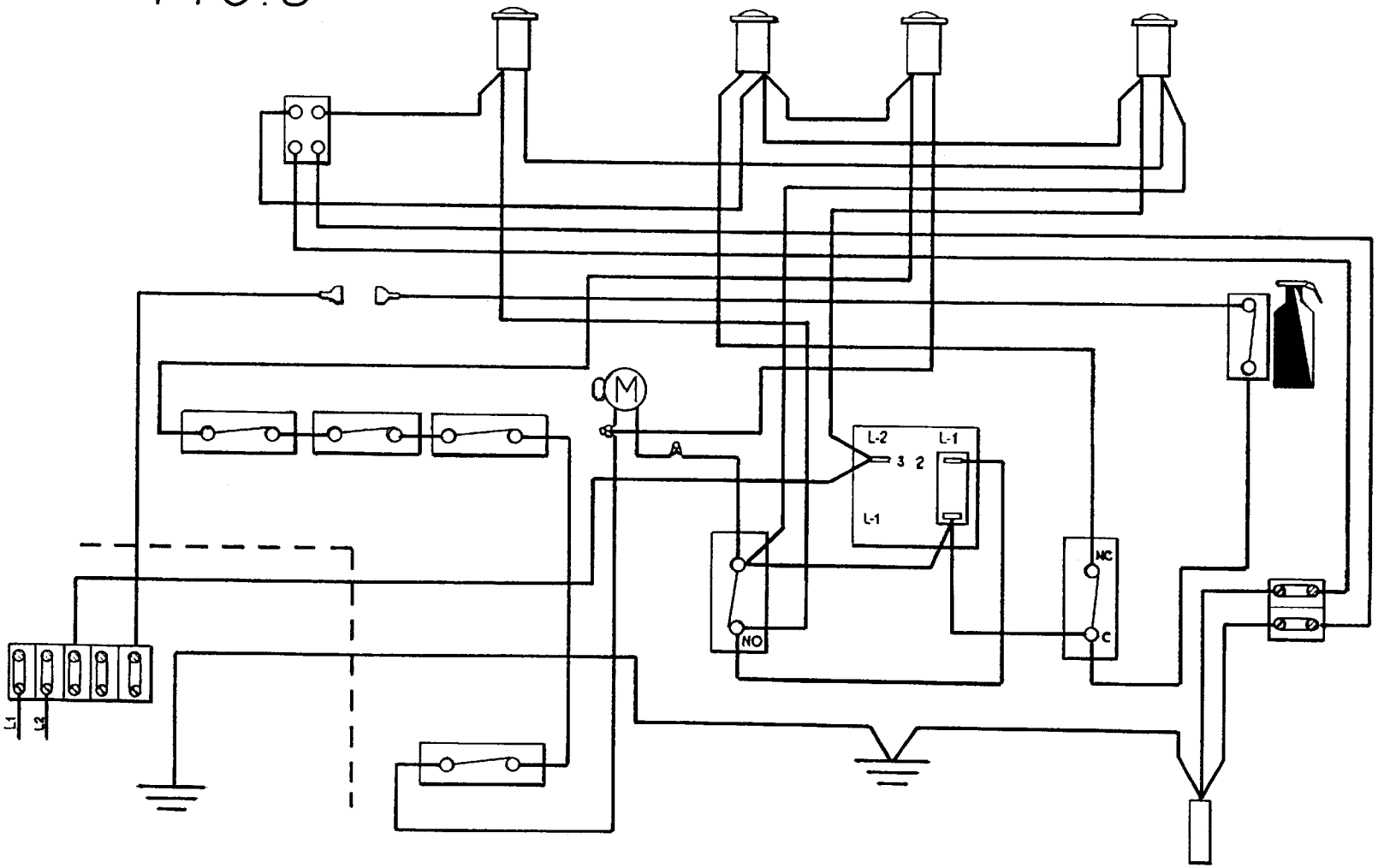
FIG. 8 is a schematic diagram of the device of FIG. 1 which will be understood by those skilled in the art.

FIG. 8 is a schematic which will be understood by those skilled in the art.

The drawings and description above have included identical (mirror image) front and rear filtering arrangements. It is to be understood that a single filtering arrangement (either the front or rear) could be used effectively. In that event, the grease baffle drain plate would slope downwardly from the rear of a single unit to the front, with a single pair of grease catch trays. Another qualification is that there is no actual necessity of two grease catch trays either in the dual filtering system shown in the drawings, or in the single filtering system described here. It is not intended that any such limitation be considered or implied.

The various items referred to in the inventory of reference numerals are not to be taken as limiting. For example, grease filters are referred to. It is understood that certain other contaminate filters could be used. Blower has been referred to, this would include such items as fans and the like.

While the embodiments of this invention shown and described are fully capable of achieving the objects and advantages desired, such embodiments are for purposes of illustration only, and not for purposes of limitation.

We claim:

1. A ventilator hood comprising: a vertically oriented enclosure having a first opening adjacent a lower section; a drain plate within the enclosure depending downwardly toward said first opening; a contaminant collection container having means to allow entry of contaminants adjacent a downward edge of said drain plate; a contaminant filter within said enclosure and above said drain plate; a charcoal filter within said enclosure and above said drain plate; a HEPA filter within said enclosure and above said drain plate; air blower means adjacent a top of said enclosure a second opening adjacent said top of said enclosure connected to an air exhaust associated with said blower means; and fire suppression means associated with said enclosure.

2. The ventilator hood of claim 1 wherein said fire suppression means includes at least one automatic activation means and at least one manual activation means.

3. A ventilator hood comprising: a vertically oriented enclosure having a first opening adjacent a lower section of said enclosure; a first drain plate within the enclosure depending downwardly toward said first opening; a first contaminant collection container having means to allow entry of contaminants adjacent a downward edge of said first drain plate; a contaminant filter within said enclosure and above said first drain plate; a second opening adjacent a lower section of said enclosure; a second drain plate within the enclosure depending downwardly toward said second opening, said first and second drain plates forming an inverted "v" shape; a second contaminant collection container having means to allow entry of contaminants adjacent a downward edge of said second drain plate; a second contaminant filter within said enclosure and above said second drain plate; a charcoal filter horizontally oriented within said enclosure and above said inverted "v" formed by said drain plates; a HEPA filter within said enclosure and above said inverted "v" formed by said drain plates; air blower means adjacent a top of said enclosure; a third opening adjacent said top of said enclosure connected to an air exhaust associated with said blower means; and fire suppression means associated with said enclosure.

4. The ventilator hood of claim 3 wherein said fire suppression means includes at least one automatic activation means and at least one manual activation means operable from without the enclosure.

5. A ventilator hood comprising: a vertically oriented enclosure mountable onto an oven by means of an adapter plate; a first opening adjacent a lower section of said enclosure; a first drain plate within said enclosure depending downwardly toward said first opening; a first contaminant collection container having means to allow entry of contaminants adjacent a downward edge of said first drain plate; a contaminant filter within said enclosure and above said first drain plate; a second opening adjacent a lower section of said enclosure; a second drain plate within the enclosure depending downwardly toward said second opening, said first and second drain plates forming an inverted "v" shape; a second contaminant collection container having means to allow entry of contaminants adjacent a downward edge of said second drain plate; a second contaminant filter within said enclosure and above said second drain plate; a charcoal filter horizontally oriented within said enclosure and above said inverted "v" formed by said drain plates; a HEPA filter within said enclosure and above said inverted "v" formed by said drain plates; air blower means adjacent a top of said enclosure; a third opening adjacent said top of said enclosure connected to an air exhaust associated with said blower means; fire suppression means associated with said enclosure; first air vacuum sensing means associated with air intake means adjacent said first and second openings in said enclosure and in an air path passing through said filters before the air enters said filters; second air vacuum sensing means in said air path after the air has passed through said filters; indicator means indicating any difference between the indicated air vacuum level of the first and second air vacuum sensing means; means operable by said sensing means for indicating an action to be taken as a result of indication of difference between the said air vacuum levels; and fire suppression means associated with said enclosure operable to discharge fire suppressing substance upon equipment different from said enclosure.

6. The ventilator hood of claim 5 wherein said fire suppression means includes at least one automatic activation means within said enclosure and at least one manual activation means operable from without the enclosure.

7. A ventilator hood comprising: a vertically oriented enclosure associated with a fume producing apparatus by means of an adapter; a first opening elevated over and adjacent a lower section of said enclosure; a drain plate within the enclosure depending downwardly toward said first opening; a collection container having means to allow entry of solid or fluid materials adjacent a downward edge of said drain plate; filter means within said enclosure and vertically above said drain plate; a second opening in said enclosure adjacent the top of said enclosure connected to an air exhaust associated with air blower means; fire suppression means associated with said enclosure; first air vacuum sensing means associated with air intake means adjacent said first opening in said enclosure and in an air path passing though said filters before the air enters said filters; second air vacuum sensing means in said air path after the air has passed through said filters; indicator means indicating any difference between the indicated air vacuum level of the first and second air vacuum sensing means; means operable by said sensing means for indicating an action to be taken as a result of indication of difference between the said air vacuum levels; and fire suppression means associated with said enclosure operable to discharge fire suppressing substance on the fume producing apparatus.

8. The ventilator hood of claim 7 wherein said fire suppression means incorporates a tension means connected to a fire suppression material release means including at least one automatic activation means operable within said enclosure and at least one manual activation means operable from without the enclosure.

9. An adapter plate for positioning a ventilator hood in operable contact with a fume producing device comprising: a base consisting of an horizontally disposed rectangular plate having two sides and two ends; a pair of upstanding lips on the sides of the plate; and a pair of fume producing device mounting members on the undersides of the ends of the plate.

10. A ventilator hood including air blower means comprising: mounting adapter means cooperable with a fume producing apparatus; means to secure said ventilator hood to said mounting adapter means; means associated with said ventilator hood for directing air movement created by said air blower means through a first filter means designed to entrap solid or liquid contaminates and divert said solid or liquid contaminates to a collection chamber; second filter means; third filter means; means to indicate the condition of each of said filters; fire suppression means integral with said ventilator hood suitable to dispense fire suppression material onto said fume producing apparatus; means for automatic activation of said fire suppression means; and means for manual activation of said fire suppression means.

* * * * *